US012544682B2

(12) United States Patent
Kelly et al.

(10) Patent No.: US 12,544,682 B2
(45) Date of Patent: Feb. 10, 2026

(54) ILLUMINATING INFLATABLE BALLOON TOY

(71) Applicant: LIGHTUPTOYS.COM, LLC, Sellersburg, IN (US)

(72) Inventors: Joshua C. Kelly, New Albany, IN (US); Christopher D. Kelly, New Albany, IN (US); Max Armendariz Lalama, Sellersburg, IN (US); Christopher W. Chung, Orlando, FL (US)

(73) Assignee: LightUpToys.com LLC, Sellersburg, IN (US)

( * ) Notice: Subject to any disclaimer, the term of this patent is extended or adjusted under 35 U.S.C. 154(b) by 221 days.

(21) Appl. No.: 18/500,383

(22) Filed: Nov. 2, 2023

(65) Prior Publication Data

US 2024/0058715 A1 Feb. 22, 2024

Related U.S. Application Data

(63) Continuation-in-part of application No. 17/814,304, filed on Jul. 22, 2022, now Pat. No. 11,925,878, which is a continuation-in-part of application No. 17/335,447, filed on Jun. 1, 2021, now Pat. No. 12,097,447.

(60) Provisional application No. 63/383,268, filed on Nov. 11, 2022, provisional application No. 63/203,456, filed on Jul. 23, 2021.

(51) Int. Cl.

| | |
|---|---|
| ***A63H 27/10*** | (2006.01) |
| ***A63H 33/22*** | (2006.01) |
| *A63H 33/28* | (2006.01) |

(52) U.S. Cl.

CPC ..... *A63H 27/10* (2013.01); *A63H 33/22* (2013.01); *A63H 2027/1058* (2013.01); *A63H 2027/1075* (2013.01); *A63H 33/28* (2013.01)

(58) Field of Classification Search

CPC ..... A63H 27/10; A63H 2027/1008–1091

See application file for complete search history.

(56) References Cited

U.S. PATENT DOCUMENTS

| | | | | |
|---|---|---|---|---|
| 1,229,794 A * | 6/1917 | Salzer | F21V 33/00 | 362/253 |
| 1,409,082 A * | 3/1922 | William | A63F 9/12 | 273/157 R |
| 1,524,367 A * | 1/1925 | Papageorge | A23G 9/506 | 426/138 |
| 3,029,077 A * | 4/1962 | Benkoe | A63H 33/18 | 446/85 |
| 3,646,676 A * | 3/1972 | Mitchell | A61C 13/235 | 433/189 |

(Continued)

*Primary Examiner* — Eugene L Kim
*Assistant Examiner* — Matthew B Stanczak
(74) *Attorney, Agent, or Firm* — Jessica C. Ronald; Scott R. Cox

(57) ABSTRACT

An illuminating toy with an attachable inflatable balloon. The toy includes a housing secured to a hollow shaft. The inflatable balloon is attachable around the hollow shaft. The balloon includes a sleeve, which extends around a connector secured around the shaft. This hollow sleeve is secured in place via a female and mated locking collar, which lock around the sleeve and the shaft securing the balloon in place. The shaft and the balloon both include LED strips secured therein, which are surrounded by prismatic reflectors.

17 Claims, 15 Drawing Sheets

(56) References Cited

U.S. PATENT DOCUMENTS 3,672,083 A * 6/1972 Moran ..... A63H 3/06 40/540
3,691,704 A * 9/1972 Novak ..... E04B 1/3211 220/4.12
3,726,026 A * 4/1973 Borcherding ..... G09B 1/08 434/430
3,763,908 A * 10/1973 Norman ..... B60J 11/00 150/166
D255,988 S * 7/1980 Mascia ..... D9/518
4,212,460 A * 7/1980 Kraft ..... A63B 65/00 473/577
4,236,348 A 12/1980 DuLac
4,292,999 A * 10/1981 Szollmann ..... F16K 15/20 137/232
4,542,445 A * 9/1985 Marletta ..... F21V 3/023 446/224
4,736,281 A * 4/1988 Neumeier ..... F21V 3/023 362/186
4,737,133 A * 4/1988 Neumeier ..... G08B 5/00 446/222
4,794,498 A * 12/1988 Neumeier ..... B64B 1/40 362/186
4,823,943 A * 4/1989 Chang ..... A45C 11/005 D3/264
4,886,273 A * 12/1989 Unger ..... A63F 9/34 273/455
4,991,847 A * 2/1991 Rudell ..... A63F 9/0278 473/594
4,997,403 A * 3/1991 Akman ..... F21V 3/023 446/485
5,016,154 A * 5/1991 Leeyeh ..... F21V 21/10 362/431
5,018,450 A * 5/1991 Smith ..... F42B 12/40 102/513
5,036,985 A 8/1991 Lovik
5,075,830 A * 12/1991 Perez ..... A63H 27/10 362/253
5,083,250 A * 1/1992 Malcolm ..... G09F 21/06 362/202
5,119,281 A * 6/1992 Akman ..... F21V 3/023 446/485
5,127,652 A * 7/1992 Unger ..... A63F 9/0278 446/419
5,138,535 A * 8/1992 Aragon, Jr. ..... A63H 33/30 446/175
5,240,450 A * 8/1993 Graham ..... F42B 12/50 473/577
5,254,379 A * 10/1993 Kotsiopoulos ..... B29C 66/71 428/34.1
5,444,607 A * 8/1995 Dreyfuss ..... F21V 3/023 362/157
5,464,354 A * 11/1995 Akman ..... H01R 33/09 439/930
5,499,941 A * 3/1996 Penjuke, Sr. ..... F21V 3/023 137/853
5,538,456 A * 7/1996 Liu ..... A63H 33/30 473/577
5,669,702 A * 9/1997 Wang ..... F21V 3/023 446/485
5,688,567 A * 11/1997 Daulton ..... G09F 19/12 428/11
5,807,157 A * 9/1998 Penjuke ..... G09F 21/10 446/224
5,848,946 A * 12/1998 Stillinger ..... A63B 21/00069 473/594
5,857,760 A * 1/1999 Pelton ..... A63H 27/10 244/33
5,879,219 A * 3/1999 Penjuke ..... F21V 3/023 137/853
5,951,140 A * 9/1999 Feldman ..... H05B 33/02 362/253
5,975,983 A * 11/1999 Panec ..... A63H 33/30 141/114
6,050,438 A * 4/2000 Kovens ..... B65D 11/02 220/4.24
6,106,135 A * 8/2000 Zingale ..... A63H 27/10 362/186
6,163,889 A * 12/2000 Tate ..... A63B 57/353 2/209.13
6,250,005 B1 * 6/2001 Richards ..... B65D 25/36 150/901
6,250,985 B1 * 6/2001 Nicholson ..... A63H 37/00 446/368
6,422,559 B1 * 7/2002 Utkin ..... A63F 9/0834 74/29
6,527,616 B1 * 3/2003 Li ..... A63B 43/005 473/574
6,533,637 B1 * 3/2003 Liao ..... A63H 33/00 446/486
6,602,105 B1 * 8/2003 Sussell ..... A63H 27/10 362/253
6,730,339 B2 5/2004 Chan
7,204,740 B2 * 4/2007 Petell ..... G09F 21/06 362/362
7,481,727 B2 * 1/2009 Chia ..... A63B 43/00 473/577
7,547,019 B2 * 6/2009 Chen ..... A63F 9/0865 273/156
7,825,944 B2 * 11/2010 Kaiya ..... B41J 29/13 347/108
D628,657 S 12/2010 Heining et al.
7,854,642 B2 * 12/2010 Nelson ..... A63H 27/10 446/224
9,113,724 B1 8/2015 Heining et al.
9,957,707 B1 * 5/2018 Cooper, Jr. ..... F21S 4/20
10,197,210 B2 * 2/2019 Hoffman ..... F16L 59/14
10,449,467 B1 * 10/2019 Vaca ..... A63H 37/00
10,562,663 B2 * 2/2020 Mowbray ..... B65D 11/02
10,704,761 B1 * 7/2020 Zhu ..... F21V 19/00
10,888,798 B1 * 1/2021 Vaca ..... A63H 33/00
11,198,041 B2 * 12/2021 Oh ..... A63B 43/004
11,358,072 B2 * 6/2022 Greenwood ..... A63H 23/12
11,426,674 B2 * 8/2022 Mowbray ..... A63H 33/003
11,786,835 B1 * 10/2023 Xiong ..... A63H 23/12 446/267
2002/0089843 A1 * 7/2002 Lou ..... F21V 3/023 362/186
2004/0174718 A1 * 9/2004 Ohlund ..... B64B 1/50 362/565
2004/0233674 A1 * 11/2004 Vanderschuit ..... G09F 21/10 362/352
2005/0170739 A1 * 8/2005 Zoellner ..... A63H 33/046 446/92
2005/0248090 A1 * 11/2005 Anders ..... A63F 9/0865 273/156
2005/0269442 A1 * 12/2005 Nguyen ..... A63H 27/10 244/31
2006/0037682 A1 * 2/2006 Reiter ..... A45C 13/26 150/107
2006/0104070 A1 * 5/2006 Carito ..... A63H 27/10 362/800
2006/0141898 A1 * 6/2006 Petell ..... A63H 27/10 446/220
2006/0234600 A1 * 10/2006 Pacheco ..... A63H 33/046 446/124
2006/0291217 A1 * 12/2006 Vanderschuit ..... A63H 33/22 362/363
2007/0167107 A1 * 7/2007 Petell ..... A63H 27/10 446/220
2008/0032588 A1 * 2/2008 Sun ..... G09F 21/10 362/565
2008/0090487 A1 * 4/2008 Randall ..... A63H 33/22 446/225
2008/0242190 A1 * 10/2008 Hofer ..... H03L 7/16 345/82
2010/0048097 A1 * 2/2010 Ma ..... F21S 4/22 446/485

(56) References Cited

U.S. PATENT DOCUMENTS

2010/0194043 A1* 8/2010 Pavlovic ..... A63F 9/0873 273/157 R
2010/0246165 A1* 9/2010 Diaz ..... A63H 33/22 362/183
2010/0301558 A1* 12/2010 Speegle ..... A63F 9/12 273/153 S
2011/0003655 A1* 1/2011 Chernick ..... A63B 39/00 446/491
2012/0129420 A1* 5/2012 Wu ..... A63H 27/10 446/220
2012/0148765 A1* 6/2012 Halliburton ..... A63H 27/10 156/292
2013/0061431 A1* 3/2013 Naftali ..... H01F 7/0263 24/303
2014/0096867 A1* 4/2014 Cayton ..... F21S 10/02 141/98
2014/0137450 A1* 5/2014 Knez ..... G09F 7/18 40/600
2014/0221136 A1* 8/2014 Forutanpour ..... A63B 59/00 473/569
2014/0295728 A1* 10/2014 Cayton ..... F21V 3/026 446/220
2014/0295732 A1* 10/2014 Henrik ..... A63H 27/10 446/485
2014/0342859 A1* 11/2014 Newman ..... A63B 45/00 473/607
2015/0224863 A1* 8/2015 Yang ..... B60J 11/08 150/168
2015/0314213 A1* 11/2015 Zhou ..... A63H 33/22 446/485
2016/0001918 A1* 1/2016 Orion ..... B65D 11/02 220/4.24
2016/0008730 A1* 1/2016 Stubenfoll ..... A63H 33/22 446/170
2016/0018083 A1 1/2016 Kelly et al.
2016/0021915 A1* 1/2016 Baxter ..... B65D 85/60 426/295
2016/0074759 A1* 3/2016 Kelly ..... A63H 1/24 446/242
2017/0021232 A1* 1/2017 Sullivan ..... A63B 37/0044
2017/0266578 A1* 9/2017 Apyshkov ..... A63H 33/046
2017/0293060 A1* 10/2017 Hayashi ..... A63H 27/10
2018/0059319 A1* 3/2018 Carlyle ..... A63H 27/10
2018/0229885 A1* 8/2018 Mowbray ..... B65D 5/009
2019/0201749 A1* 7/2019 Burke ..... A63B 37/004
2019/0374788 A1* 12/2019 Ko ..... A61F 13/0206
2020/0184852 A1* 6/2020 Hartloff ..... G09B 27/08
2021/0379503 A1* 12/2021 Kelly ..... A63H 33/22
2021/0387105 A1* 12/2021 Greenwood ..... A63H 23/12
2022/0203256 A1* 6/2022 Chen ..... A63B 67/002
2022/0379232 A1* 12/2022 Kelly ..... A63H 33/28
2023/0111031 A1 4/2023 Kelly et al.
2023/0277953 A1 9/2023 Kelly et al.
2023/0277954 A1 9/2023 Kelly et al.
2024/0058715 A1* 2/2024 Kelly ..... A63H 27/10
2024/0066424 A1 2/2024 Kelly et al.

* cited by examiner

ILLUMINATING INFLATABLE BALLOON TOY

CROSS-REFERENCE TO RELATED APPLICATIONS

This application claims the benefit of provisional application No. 63/383,268 filed on Nov. 11, 2022 and is also a continuation-in-part application that claims the benefit of application Ser. No. 17/814,304 filed on Jul. 22, 2022 (which is pending), which claimed the benefit of provisional application Ser. No. 63/203,456, filed Jul. 23, 2021 and was also filed as a continuation-in-part claiming benefit from patent application Ser. No. 17/335,447 filed Jun. 1, 2021 (which is pending). The entire contents of the above applications are incorporated herein by reference.

FIELD OF INVENTION

The invention relates to the technical field of inflatable balloon toys. Particularly, inflatable balloon toys that include light emitting diodes ("LEDs") that reflect light through a prismatic reflector into the balloon.

BACKGROUND OF THE INVENTION

Electronic bubble producing toys exist, such as bubble wands or bubble swords. However, these existing toys do not include an inflatable balloon that attaches thereto, for example around a shaft of the wand or sword. Moreover, they do not include an inflatable balloon that is easily interchangeable with other balloons. Moreover, although these existing toys may include LEDs, they do not include a prismatic reflector that splits light from the LEDs into the balloon in a unique pattern.

Further, inflatable balloon toys exist, however, many of the balloons are single use because the balloon is not easily removeable without breaking the toy or popping the balloon. Furthermore, existing reusable balloons slowly leak air over time due to the way in which they are secured to the toy, and they pop easily as they are made of a nondurable material. Accordingly, these balloons cannot be reused in the future and only last for a short period of time. Furthermore, existing balloon toys are not capable of housing the various electronics necessary to illuminate the balloons in concert with a sound playing from a speaker secured within the toy.

SUMMARY OF THE INVENTION

An illuminating balloon toy with a hollow shaft with a first and second end, wherein shaft contains a first LED strip. The housing is secured to the first end of the shaft. The inflatable balloon is secured around the second end of the shaft. A first LED strip is secured within the hollow shaft and a second LED strip is secured to the second end of the shaft within the inflatable balloon, for instance, within a hollow tube. The first and second LED strips are electrically connected. A first and second prismatic reflector are secured around the first and second LED strips, which creates a unique prismatic pattern within the balloon and the shaft when the first and second LED strips are illuminated. The toy further includes a speaker secured within the housing, wherein the illumination of the first and second LED strips illuminate in synchronization with a sound played through the speaker.

DETAILED DESCRIPTION

Figure 1:
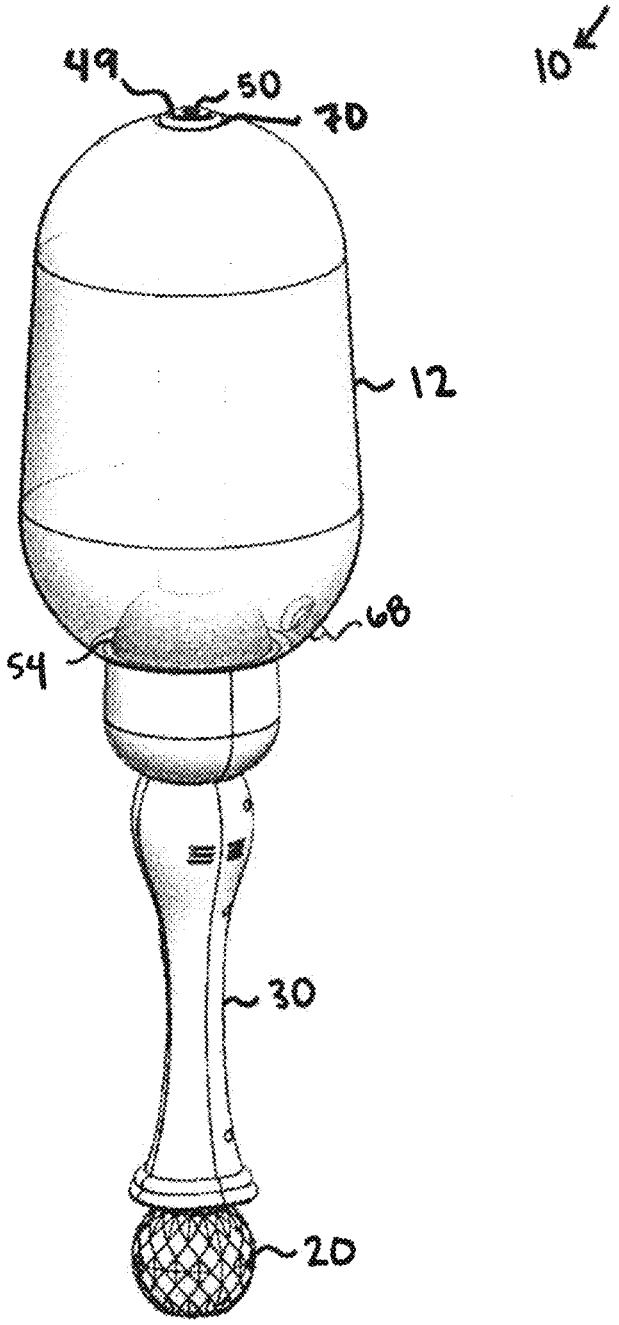
FIG. 1 is a front view of an illuminating bubble producing toy with one embodiment of an inflatable balloon attached thereto and prismatic light reflector.

FIGS. 1-5 illustrate various views of an illuminating bubble producing toy 10 with different embodiments of an attachable inflatable balloon 12, 13, 15 and light reflector 54, 59. FIG. 6 shows a second embodiment of an illuminating bubble producing toy 100 with another embodiment of an attachable inflatable balloon 112 and light reflector 154. FIGS. 7-15 show various views of an illuminating balloon toy 200 which includes another embodiment of an attachable inflatable balloon 280 and various light reflectors 246, 263.

As shown in FIGS. 1-2 and 4-5, the toy 10 includes a bubble producing solution reservoir 20, which contains liquid, such as bubble solution. When this bubble solution is pumped through the toy, bubbles are produced through an orifice 50 located in a top portion of the toy. The bubble solution is preferably non-toxic and non-slippery when the bubbles fall to the ground. The reservoir preferably has a flat bottom, so the toy can be placed on a surface. The reservoir varies in size depending on the overall size of the toy. The reservoir is easily removed from the housing 30, so a user can easily refill the bubble solution, which increases the longevity of the toy.

Figure 2:
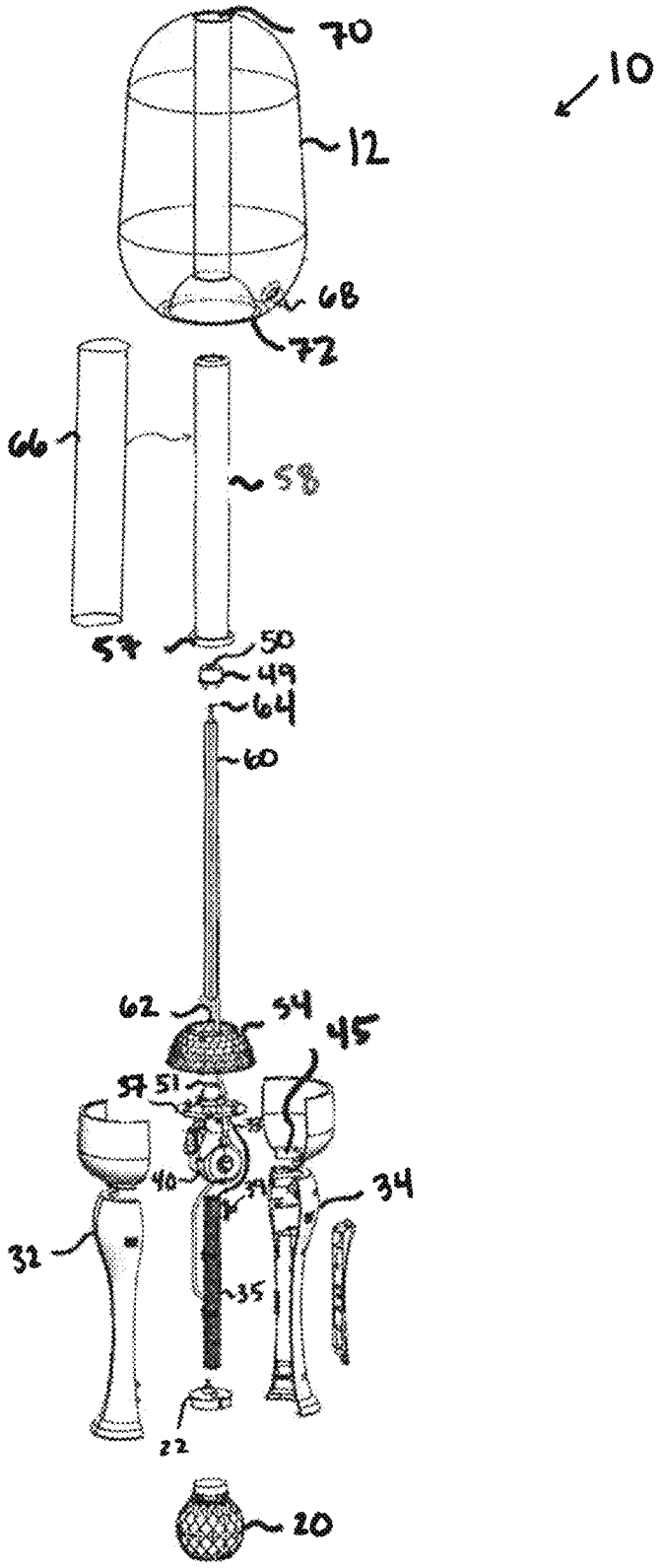
FIG. 2 is a partially exploded view of the illuminating bubble producing toy with the inflatable balloon shown in FIG. 1.
Figure 3:
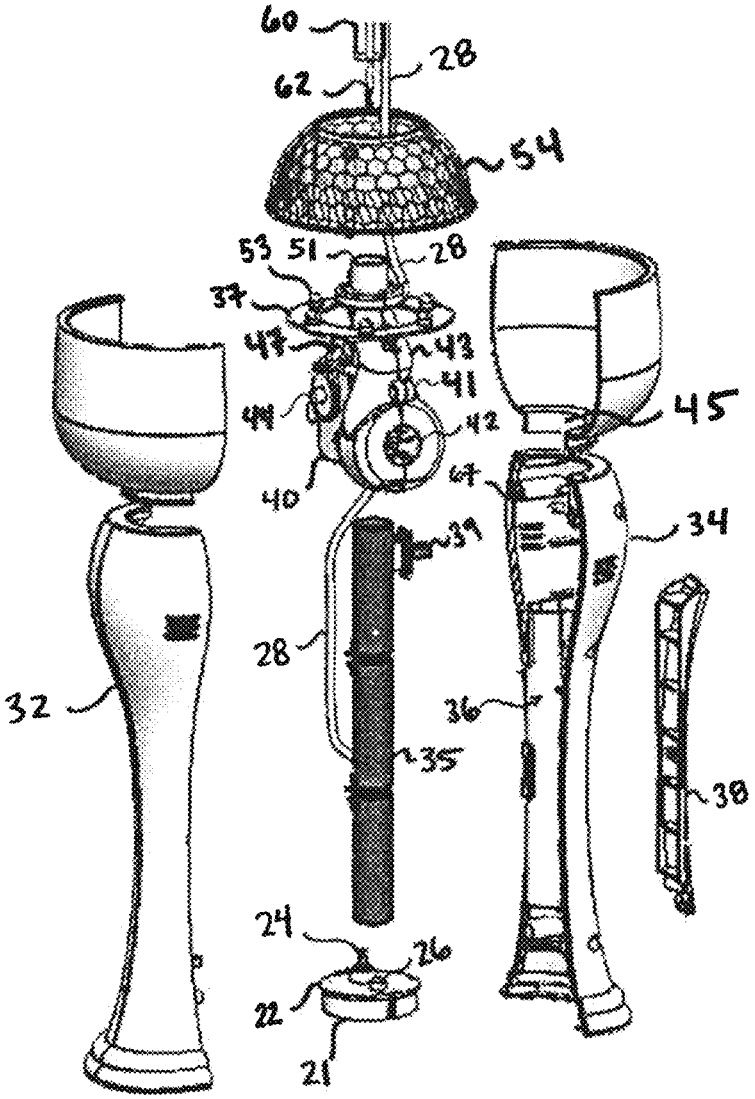
FIG. 3 is an exploded view of a housing of the illuminating bubble producing toy with the inflatable balloon shown in FIG. 1.
Figure 4:
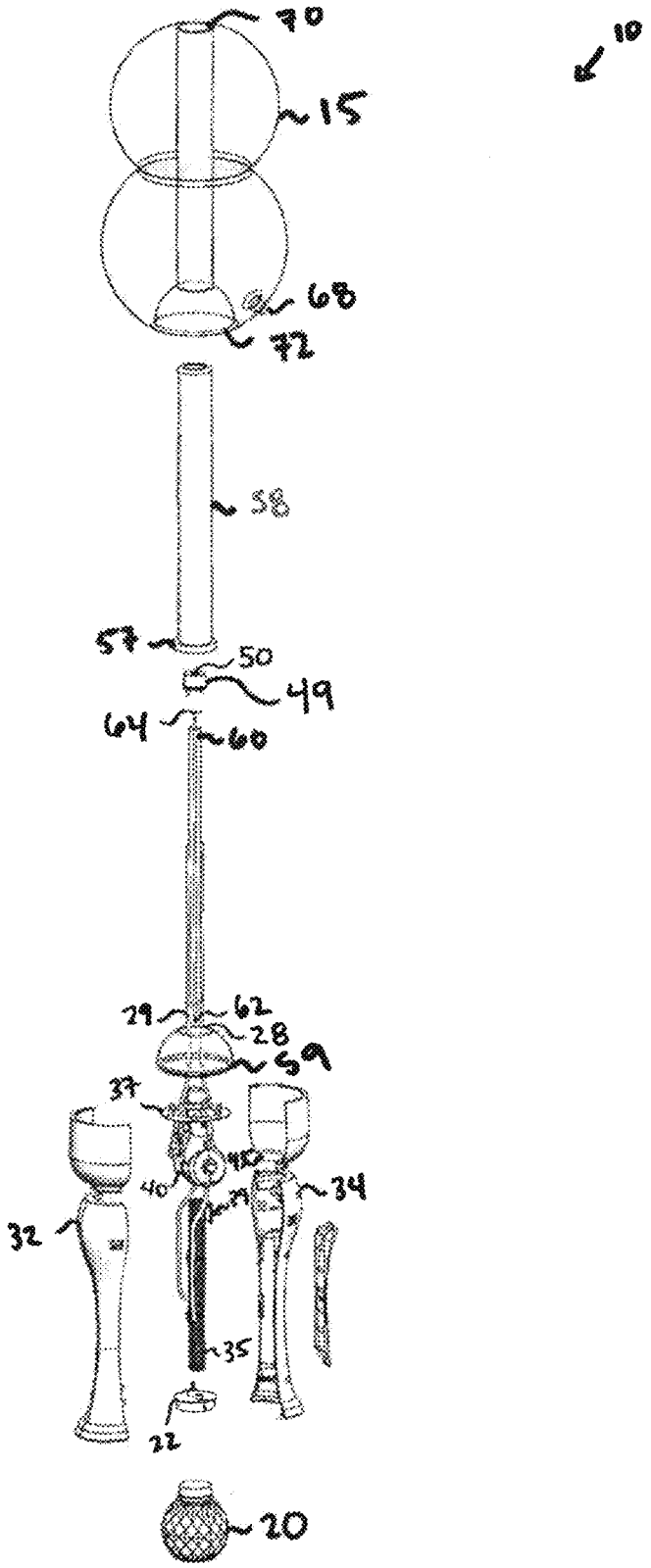
FIG. 4 is a partially exploded view of the illuminating bubble producing toy shown in FIG. 1 with another embodiment of an inflatable balloon and light reflector.

As shown in FIGS. 2-4, most particularly FIG. 3, the reservoir 20 includes a cover 22, that connects to a top portion thereof and prevents solution from spilling out of the reservoir and into the other portions of the toy 10. One way in which the cover connects to the reservoir is via sides 21 that protrude downward from the cover and secure within the reservoir or around the reservoir, for instance via friction-fitting or clasps. The cover includes an opening 24 for the connection of a bubble solution supply channel 28 through which the solution submerged within the reservoir is pumped through the toy to a nozzle 49. The channel includes a tubular structure and is snug fit into the opening or around a converter secured within the opening so that one end of the channel is submerged within the solution in the reservoir. The cover of the reservoir also includes an opening 26 for the connection of a bubble solution recirculation channel 29, which channel also includes a tubular structure. The recirculation channel runs through the toy with one end connected to the nozzle in a top portion of the toy and the other end connected to the reservoir. Excess bubble solution that gathers in the nozzle is pumped or drained therefrom back to the reservoir for reuse. Advantageously, excess solution is recycled throughout the toy and does not leak into the housing where the electronics of the toy are stored. The portion of the recirculation channel the connects to the reservoir includes a ball valve or ball bearing, so that if a user turns the toy upside down, liquid is prevented from leaking out of the reservoir and into the housing.

As shown in FIGS. 1-2 and 4, the reservoir 20 is connected to the housing 30 by twisting or screwing the reservoir into the housing. The housing is enclosed and is designed in a handle shape for the user to comfortably hold the toy 10. The housing is preferably made of a lightweight, but durable material such as plastic that can withstand being dropped without breaking. The housing is hollow and is made of one monolithic piece or consists of a front 32 and back cover 34 secured together, for instance via screws. The housing includes a power source for operation of the toy, such as batteries 35, which are secured within a battery compartment 36. As shown in FIGS. 2-4, the battery compartment is located within the back cover of the housing. The battery compartment includes a casing 38 that secures the batteries within the compartment, for instance via screws. The batteries are electrically connected to a button or switch 39 that is pressed by a user to activate the toy and controls various functions of the toy. The battery compartment includes a fuse that protects the power source from overheating by cutting the power source if the temperature rises above safety requirements. The button is multi-functional and controls multiple settings of various electronic operations of the toy. For example, the toy includes an LED module, which includes various LEDs 53 that are electrically connected to control circuitry 37, which LEDs vary in color, luminosity, and intensity. In one manner of operation, when a user pushes the switch once, it illuminates all the LEDs. If a user pushes the switch again, the LEDs flicker. If the user pushes the switch again, the LEDs change color. These functions are not meant to be exhaustive. Furthermore, the switch controls the speed at which the bubbles are produced.

As shown in FIGS. 2-4, the toy 10 includes circuitry or control circuitry 37, such as a printed circuit board, that controls the various operations of the toy. The printed circuit board is electrically connected via wiring 33 to the battery 39, which is electrically connected to the button and is further electrically connected to the various LEDs 53. The printed circuit board is preprogrammed so each push of the button 39 produces a different effect within the toy. For instance, one push of the button activates bubble production and a unique illumination of the LEDs. A second push only activates the illumination of the LEDs, and a third push produces different unique illumination of the LEDs. Further, the button is replaceable with or used in addition to a software or signal-controlled switch that is controlled by an internal controller and corresponding circuitry of the toy, which is communicatively activated by a remote device. The switch or other circuitry also incorporates activation through embedded instructions and or receipt of activation signals received by a receiver and included electronics and circuitry. For example, the toy includes a receiver for receiving signals, which activates the illumination or bubble production of the toy. The switch or other circuit further incorporates proximity detection devices, such as, for example, RFID or other types of electronics, which sense location, proximity or other wireless operations, which provide instructions for or instruct illumination or other various functions of the device. Such devices include instructions and circuitry operable to detect location in respect to a transmitted beacon.

For example, the toy 10 automatically activates upon nearing a display, feature, attraction, or other location within an amusement park, which is transmitting a unique beacon. When this beacon is received by the toy, the toy illuminates or produces bubbles in a predetermined manner. Other possible automated instructions include emitting colors, playing predefined audio stored in memory of the toy or received by the receiver of the toy, playing signals which are streamed and received by the receiver, and similar functionality. Furthermore, the toy includes a sender that transmits a signal to a display, feature, attraction of other location within an amusement park. Accordingly, when a user with the toy nears a display, feature, attraction, or other location, which can receive a unique beacon being sent from the toy, the display, feature, attraction etc. illuminates in a predetermined manner, for example, mirroring the feature of the toy.

As shown in FIG. 2, the housing 30 includes wiring 33 that electrically connects the power source to the other electrical components of the toy 10, most of which are secured within the housing. As shown in FIGS. 2-4, a bubble engine 40 is secured to an inner surface of the housing, for instance when the front cover 32 and back cover 34 are secured together. FIG. 3 is a zoomed in view of the open housing and inner components thereof, which are also shown in FIGS. 2 and 4. It is understood that FIGS. 2 and 4 include the components shown in FIG. 3. The bubble engine contains the structural components necessary for pumping bubble solution from the reservoir 20 and through the discharge orifice 50. The bubble engine is like the bubble engine found in the bubble producing wand, which is made by Applicant and is disclosed in U.S. patent application Ser. No. 17/335,447, which application is incorporated by reference herein in its entirety. As shown in FIG. 3, the bubble engine is secured within an enclosed shell 41 that is water resistant or waterproof and advantageously aids in protecting the electronic components from being damaged by leaking bubble solution. The shell is made of plastic and is secured via screws to various pegs 67, which prevents the shell from shifting within the housing. As shown in FIGS. 2-3, the shell includes a front cover and a back cover, which are secured together, for instance via screws. The shell may also be manufactured to be one piece. The shell is configured in a predetermined shape so that, when the front and back covers are secured together, the various components within the shell are secured in place. The shell is configured to contain a motor 44 that is electrically connected to a pump 47, which is connected to a gearbox and an air producing device 42. The motor can be any type of motor that most effectively produces the amount of energy needed to create the precise number of rotations necessary to generate the desired quantity of bubbles. Advantageously, the rotational speed of the motor is reduced to a specific rpm so that there is less solution on the nozzle 60 of the toy 10, which avoids solution overflow into the toy. Further, this motor also generates the necessary airflow rate to create the desired quantity of bubbles. Further, the toy advantageously uses less electric current because of the slowed speed of the motor, therefore increasing battery life of the toy. The motor is connected on one end to the air producing device and on an opposite end to a worm gear that drives both the pump and the wiper 64.

To further aid in producing the desired size and quantity of bubbles is the type of pump 47 used, which is preferably a peristaltic pump. This pump is connected to the gearbox, which includes a plurality of gears for controlling the speed of the pump to produce the correct number of bubbles per minute. The pump operates in combination with the gearbox, which draws the bubble solution from the reservoir 20 through the channel 28. A specific number of gears are utilized to control the rate at which the solution is pumped from the reservoir and through the channel. The channel further extends upwardly through the outer tube 58 and connects on a second end to the nozzle 49.

The motor 44 is also electrically connected to the air producing device 42. The air producing device is any device that produces an airstream with the velocity needed to project the solution through the discharge orifice 50 of the nozzle 49, such as a fan. The air duct 43 is a hollow tube that is secured to, part of or formed by the shell 41. The air duct is bent at an angle to aid in creating the precise number of bubbles so as to not overheat the toy. Secured to the top portion of the air duct is an air discharge orifice 51, through which air is pushed. Secured inside this air discharge orifice is a drive shaft 62, which is connected on a bottom end to the motor via a crown gear. On a second end of this driveshaft is a wiper 64, which rotates via the motor. The solution channel 28 connects to the nozzle so bubble producing solution drips into a trough in the nozzle. This nozzle is like that found in the bubble producing wand, which is made by Applicant and is disclosed in U.S. patent application Ser. No. 17/335,447, which application is incorporated by reference herein in its entirety. The three-hundred-and-sixty-degree rotation of the wiper around the trough forms a film, which film creates bubbles when air is pushed upwardly from the air producing device through the bubble discharge orifice.

As shown in FIGS. 2-4, the drive shaft 62 is secured within an inner tube 60. This inner tube aids in protecting the driveshaft and allowing its rotation without interfering with the solution channel 28 and the recirculation channel 29. The inner tube is preferably made of clear plastic so that light can be reflected therethrough. The inner tube is friction fitted to secure around the outside of the air discharge orifice 51. As shown in FIG. 4, secured to the outside of the inner tube is the recirculation channel 29 and the solution channel 28, which ultimately connect to nozzle 49 for both supplying bubble producing solution and recirculating excess bubble producing solution back to the reservoir 20. These channels are secured by any conventional means, such as glue or may secure into notches that are on the outside of the tube. Secured around the outside of the inner tube and the solution channels is an outer tube 58 that is preferably made of PVC and includes a reflective sleeve 66 that coats an inside surface of the tube. This outer tube further protects the recirculation channel and solution channel and aids in preventing solution from leaking into the rest of the toy. The outer tube is secured to a top portion of the housing 30. As shown in FIGS. 2-4, when connected, the top portion of the front 32 and back cover 34 of the housing form a shelf 45. A base 57 of the outer tube securely fits into this shelf and may be further secured for instance via screws. Secured to a top portion of the outer tube is the nozzle.

As shown in FIGS. 2-4, secured around a top portion of the base 57 of the outer tube 58 is an LED module which includes the printed circuit board 37 with various LEDs 53 that are electrically connected thereto. The LEDs are secured atop the printed circuit board, for instance via glue, and face upwards to project light upwards through the top portion of the toy 10. The LED module is preferably circular with a hollow center through which the outer tube 58 runs. There can be any number of LEDs present. The configuration of the LEDs works in combination with the light reflectors 54, 59 to project light through the outer tube and the balloon 12,15.

As shown in FIGS. 1-4, further secured around the base 57 of the outer tube 58 and the entirety of the LED module 52 is the light reflector 54, 59. This light reflector secures into the shelf 45 of the front 32 and back cover 34 of the housing when they are connected. The light reflector is a clear plastic and preferably includes a prismatic pattern, as shown in FIGS. 1-3 that advantageously splits the light from the LEDs and reflects said light into the inflatable balloon 12 and the outer tube in various directions and patterns. Moreover, the reflective sleeve 66 secured around the inner surface of the outer tube further reflects the light in a unique pattern. As shown in FIG. 4, another embodiment of the reflector does not include a prismatic pattern. The light reflector can have any shape, design, images, etc. to reflect the light into interesting and unique ways into the balloon and the outer tube.

Figure 5:
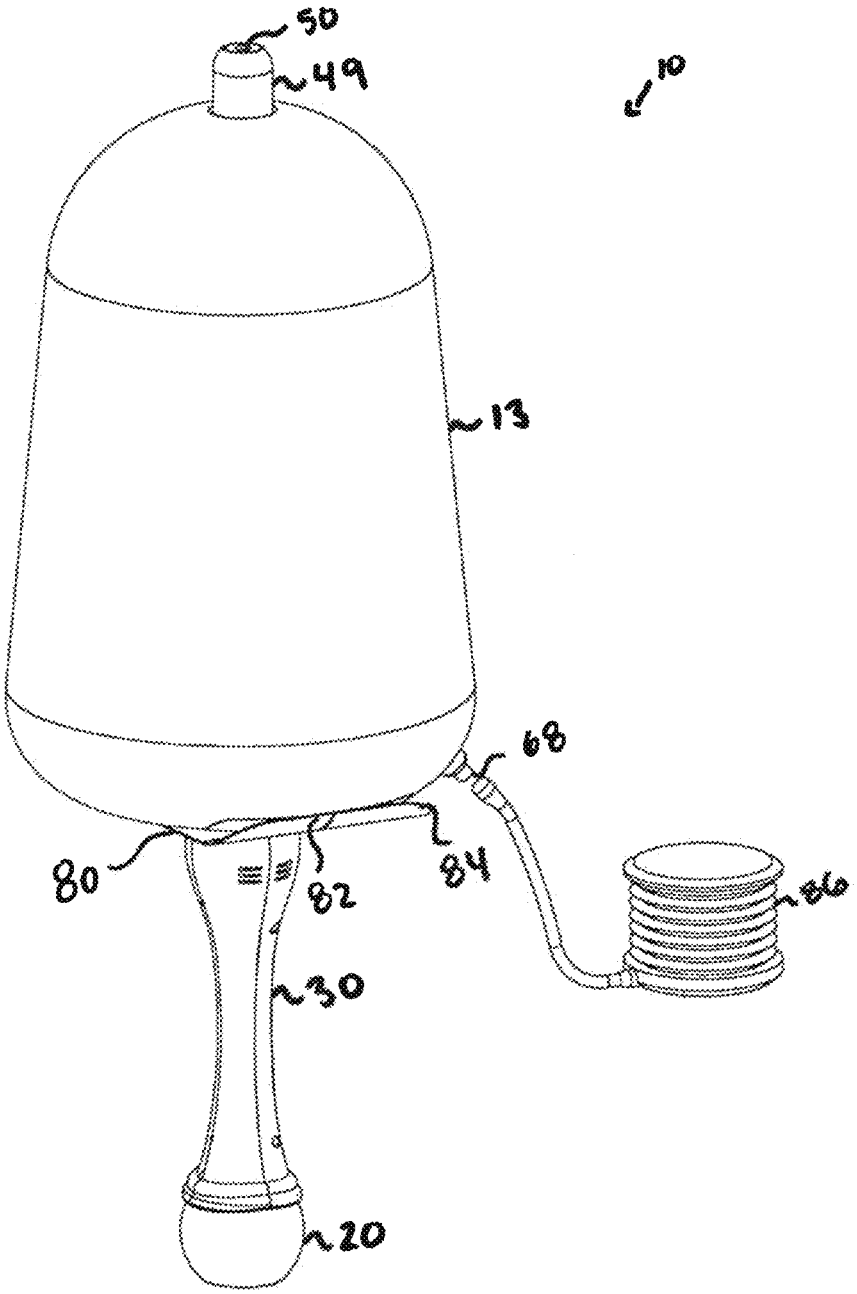
FIG. 5 is a side view of the illuminating bubble producing toy shown in FIG. 1 with another embodiment of an inflatable balloon.
Figure 6:
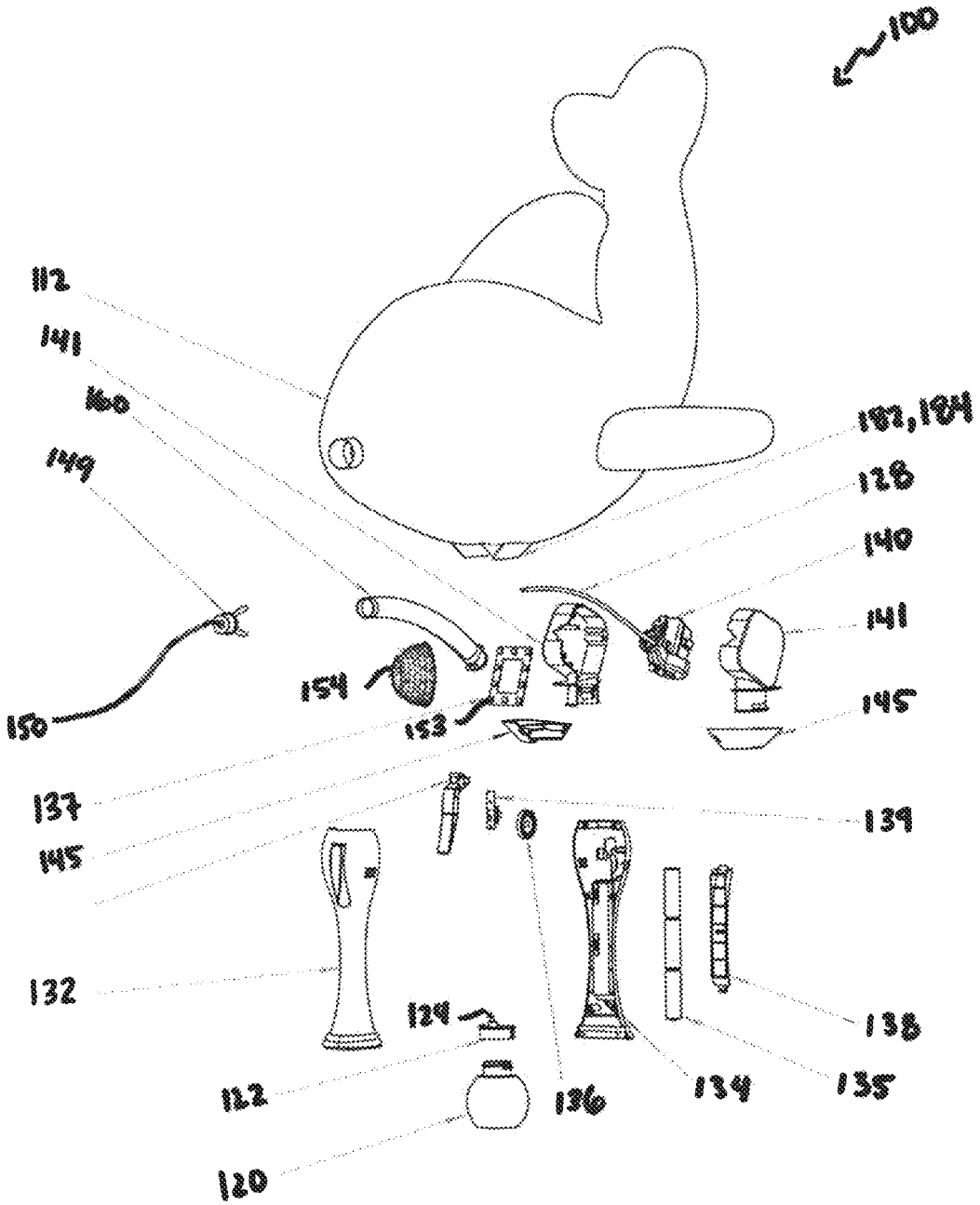
FIG. 6 is an exploded view of a second embodiment of an illuminating bubble producing toy with another embodiment of an inflatable balloon.
Figure 7:
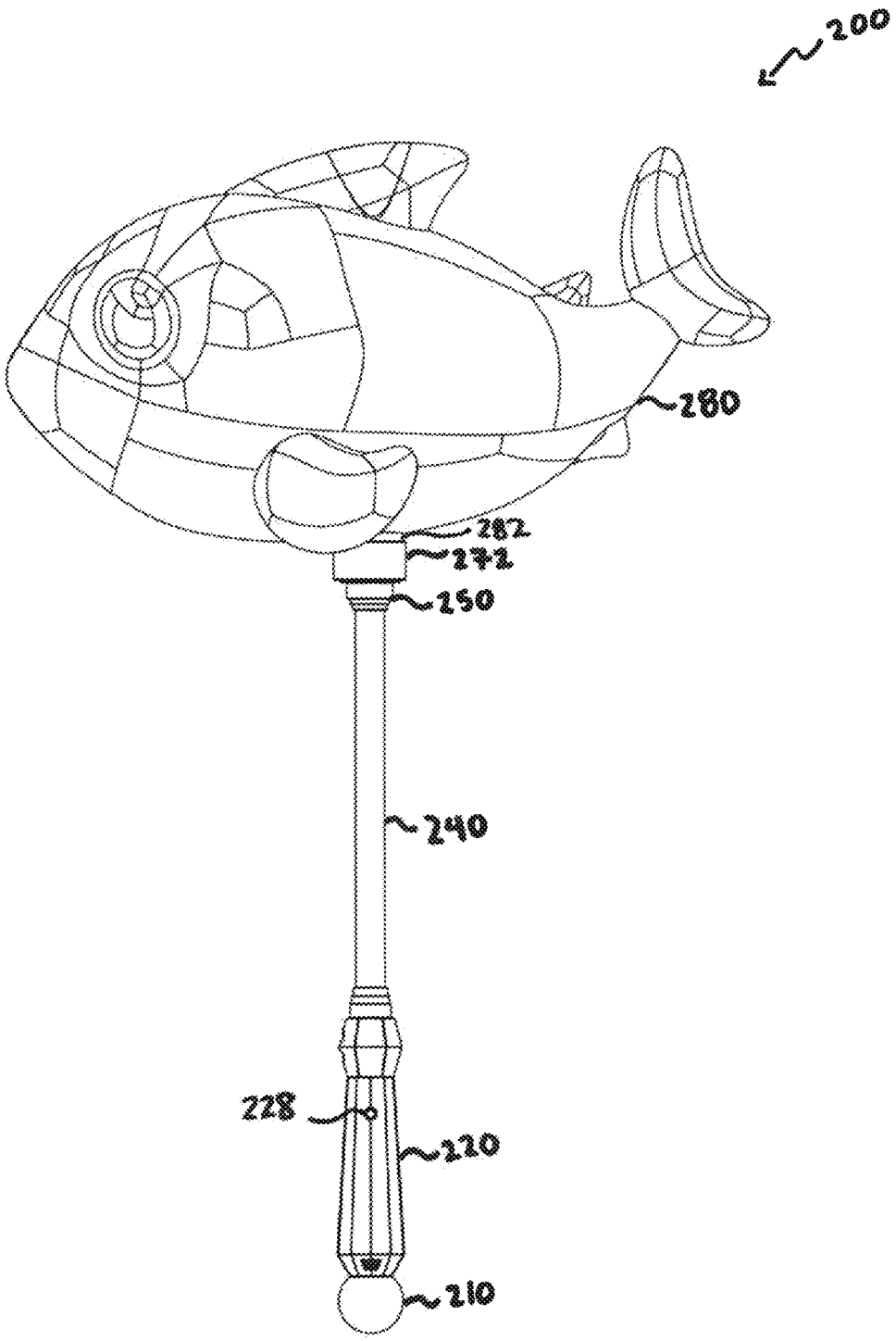
FIG. 7 is a front view of an illuminating balloon toy with a housing connected to a shaft to which another embodiment of an inflatable balloon is attached.
Figure 8:
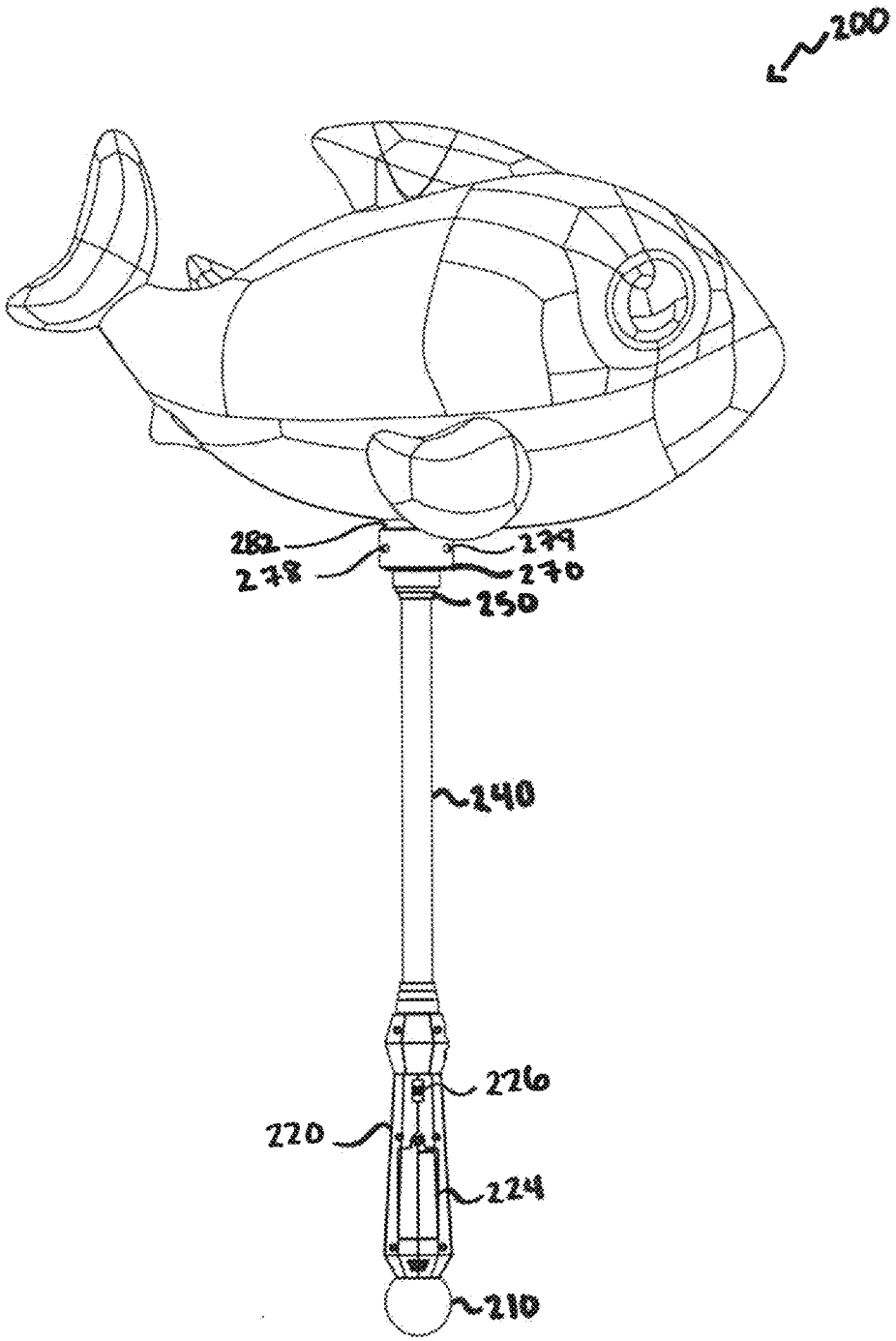
FIG. 8 is a back view of the illuminating balloon toy shown in FIG. 7.
Figure 9:
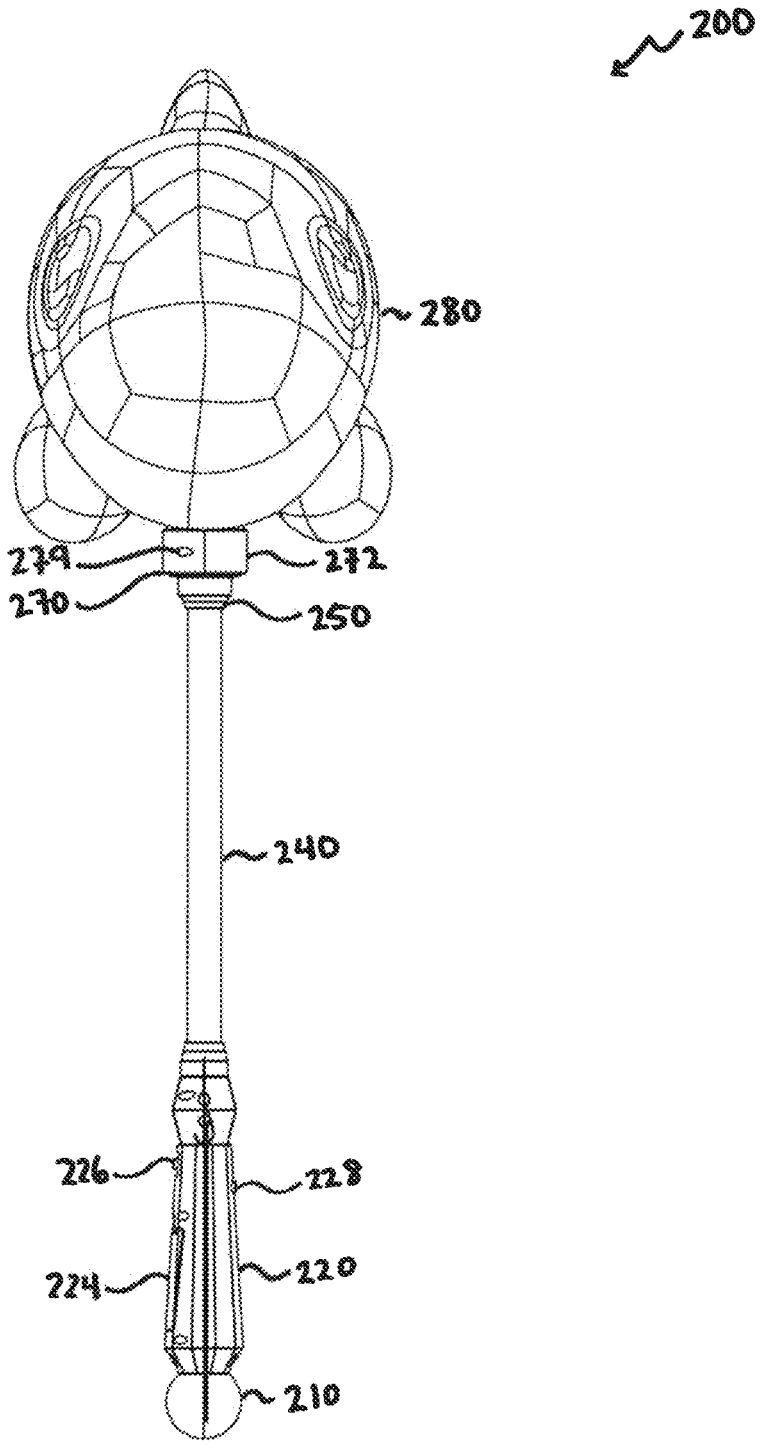
FIG. 9 is a side view of the illuminating balloon toy shown in FIG. 7.
Figure 10:
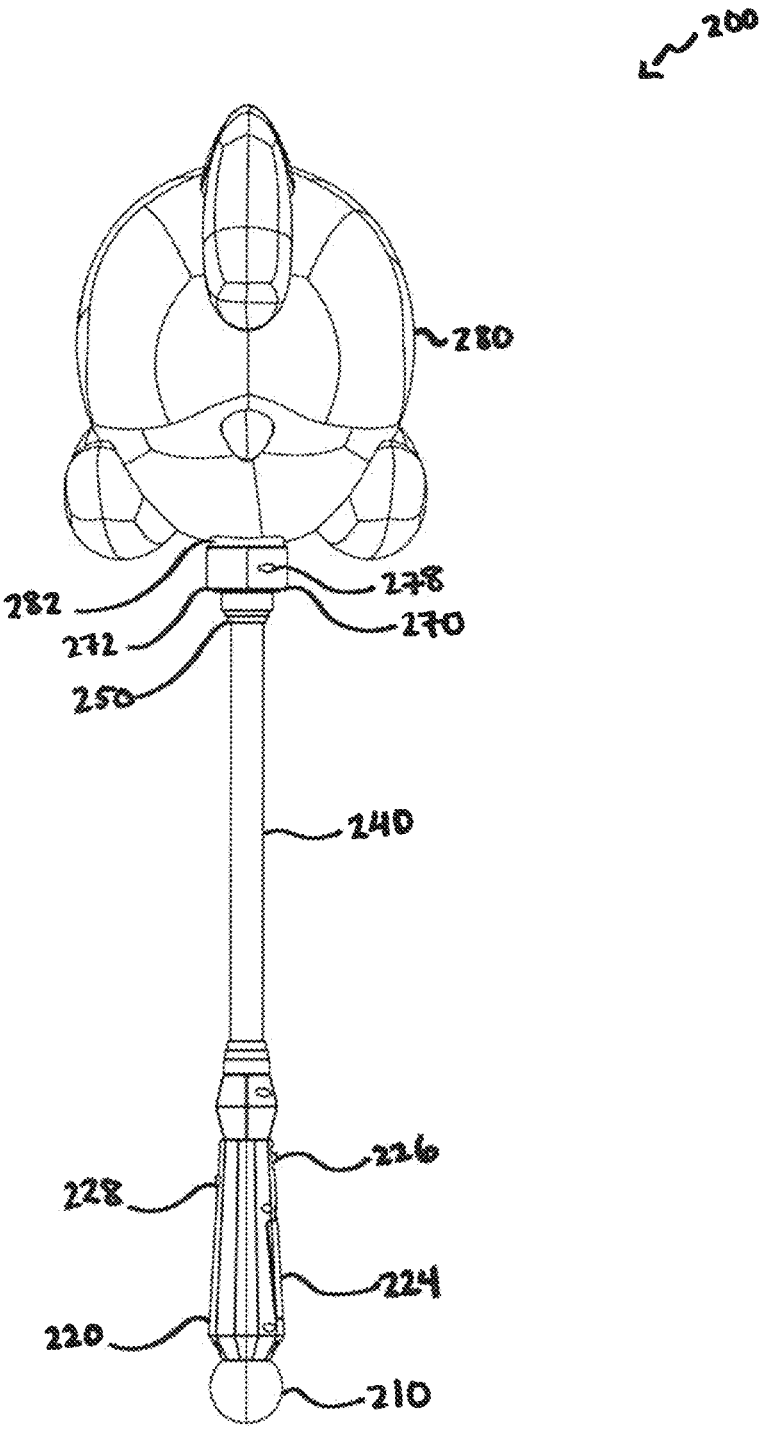
FIG. 10 is another side view of the illuminating balloon toy shown in FIG. 7.

As shown throughout FIGS. 1-2 and 4-6, the inflatable balloon 12, 13, 15, 112 varies in shape. For instance, FIG. 4 shows the balloon having two layered spheres. The embodiment of the balloon in FIG. 5 varies slightly from the shape of the balloon in FIGS. 1-2. In FIG. 6, the balloon is the shape of a whale. Advantageously, the balloon in all these embodiments is easily removeable from the toy 10. As shown in FIGS. 1 and 3-4, the inflatable balloon includes a hollow shaft 70 and a domed inlet 72. Accordingly, a user slides the balloon onto the outer tube 58 and the balloon friction fits at the bottom around the light reflector 54, 59 and around the outer tube. For example, in FIG. 1 balloon is friction fitted onto the outer tube when inflated. FIG. 5 shows a flap 80 that is secured to or part of a lower edge of the balloon. This flap aids in further securing the balloon around the outer tube. The flap includes two wings 82, 84, which separately wrap around the outer surface of the housing. The wings include tape, such as magic tape, which secures to the housing. The balloon can be any shape or size or any character depending on user preference. The balloon is preferably made of a plastic material that is capable of being inflated and deflated. The balloon can be any opacity but is preferably a white opacity so that the images and patterns reflected thereon from the light reflecting through the light reflector 54 are most easily viewed by the user. As shown in FIGS. 1-2 and 4-5, the balloon includes a nozzle 68 whereby the user can manually blow up and deflate the balloon. As shown in FIG. 5, the balloon may also be inflated and deflated electrically or with a hand pump 86.

As shown in FIG. 1, when the LEDs 53 shine light through the light reflector 54, the light reflector splits the light from the LEDs into many different light patterns. These patterns are then reflected onto the inner surface of the inflatable balloon. For example, if the control circuitry 37 instructs the LEDs to illuminate at different times, the light shining through the light reflector and into the balloon has the appearance of a moving animation. Moreover, the reflective sleeve 66 secured on the inside surface of the outer tube 58 further refracts the light into a unique pattern that is viewable to a user. The light is preferably refracted onto an inside surface of the balloon but is not projected outside the inside surface of the balloon.

When the toy 10 is in use, a user presses the button 39, which activates the electrical components of the toy, i.e., the components of the bubble engine 52 are activated and solution is pumped from the solution reservoir 20 through the solution channel 28 to the nozzle 49. Simultaneously, air is pushed from the air producing device 42 through the air discharge orifice 51 and upwardly through the inner tube 60. The air then pushes the bubbles out the top of the toy at the bubble discharge orifice 50. When the switch of the toy is pressed, printed circuit board 37 is activated, which illuminates the LEDs 53. Accordingly, the LEDs are illuminated and begin reflecting light upwardly through the light reflector 54. Depending on the illumination and timing of the LEDs, various patterns and animations are created from the light shining through the prismatic face of the reflector. The light projections reflect through the domed inlet 72 of the inflatable balloon 12, 13, 15 and onto the inner surface of the balloon. These light patterns are visible to the user through the balloon.

FIG. 6 shows a second embodiment of an illuminating bubble producing toy 100 with an inflatable balloon 112. The above disclosure for the first embodiment of the bubble producing toy 10 shall be understood as applying to the second embodiment and the elements are correspondingly labeled using the 100 reference number series. The elements necessary for creating the bubbles and illuminating the device operate the same. However, the orientation in which these components are secured within the inflatable balloon is different. Advantageously, the shape of the balloon in FIG. 6 is a whale and the inner components of the balloon are oriented so that the bubbles are emitted from a mouth portion of the whale, i.e., horizontally, rather than vertically as in the first embodiment. This is advantageous because it adds a unique user interaction whereby the bubbles are emitted from the mouth of the balloon making the balloon appear more animated. More particularly, the bubble engine 140 is secured within the balloon at about a 30-60 degree angle from that of the first embodiment. Moreover, the hollow tube 160 and the solution channel 128 are curved and extend horizontally from the bubble engine towards the nozzle 149. Advantageously, this embodiment also includes a prismatic reflector 154, which surrounds various LEDs 153, which are secured to control circuitry 137, such as a printed circuit board. In this embodiment, these LEDs and corresponding prismatic light reflector are positioned so that the light reflects not only into the balloon, but also through the bubble discharge orifice 150 so that the bubbles emitted are also illuminated in a unique prismatic pattern that appears animated. Further, in one mode of the toy, the emission of the bubbles and the illumination of the LEDs are programmed to be activated in conjunction with sound played from a speaker 136.

FIGS. 7-12 show an embodiment of an illuminating balloon toy 200. The toy includes a housing 220, which is secured between a sphere 210 and a hollow shaft 240. An inflatable balloon 280 is secured around a top edge of the shaft. The way in which the balloon secures around the shaft is advantageous because it is so airtight that no air leaks from the balloon when a user plays with the toy. Furthermore, it advantageously makes the balloon easily replaceable and interchangeable.

Figure 11:
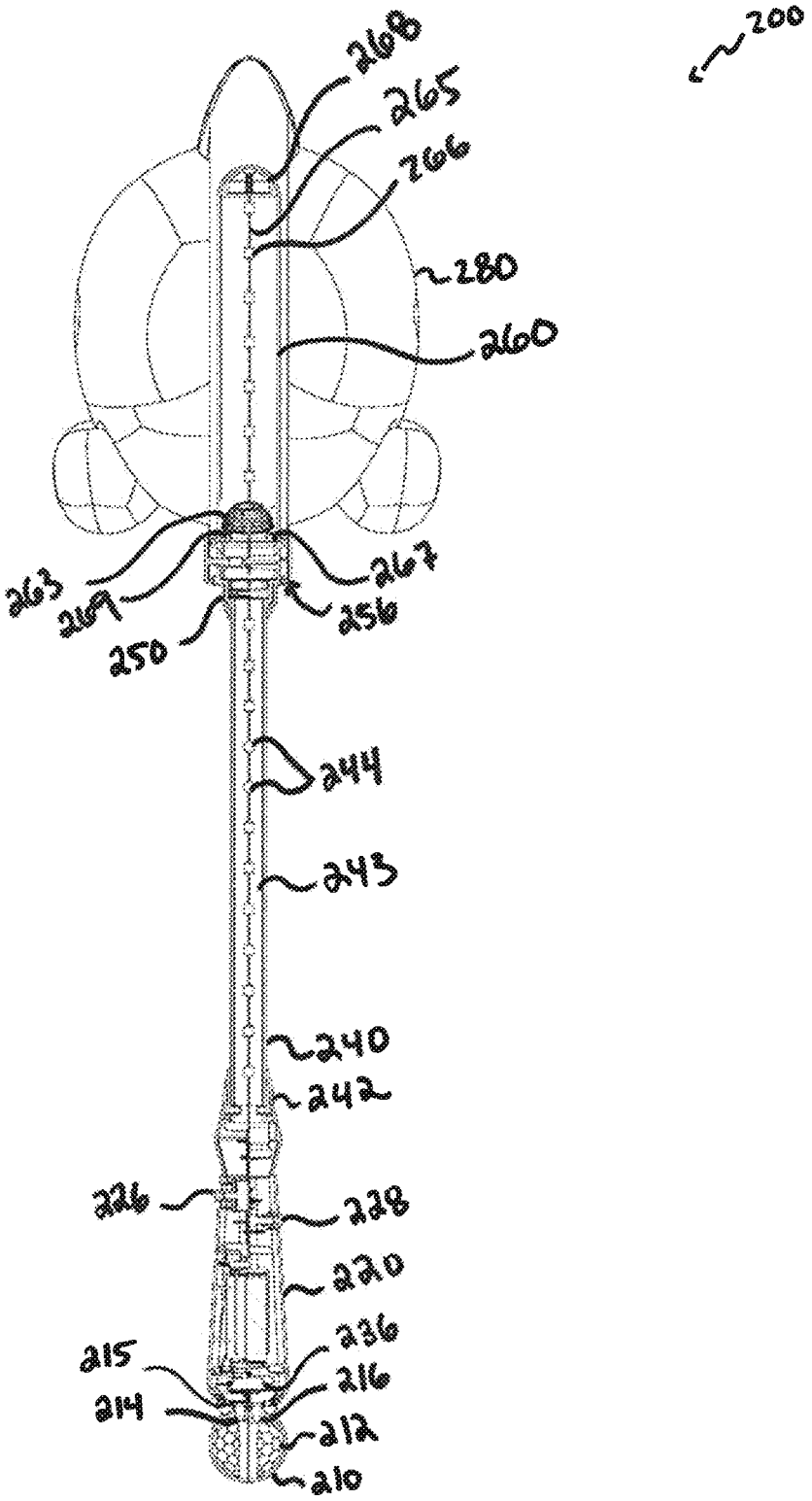
FIG. 11 shows a side, cross-section view of the illuminating balloon toy shown in FIG. 7 with a prismatic light reflector secured within the balloon.
Figure 12:
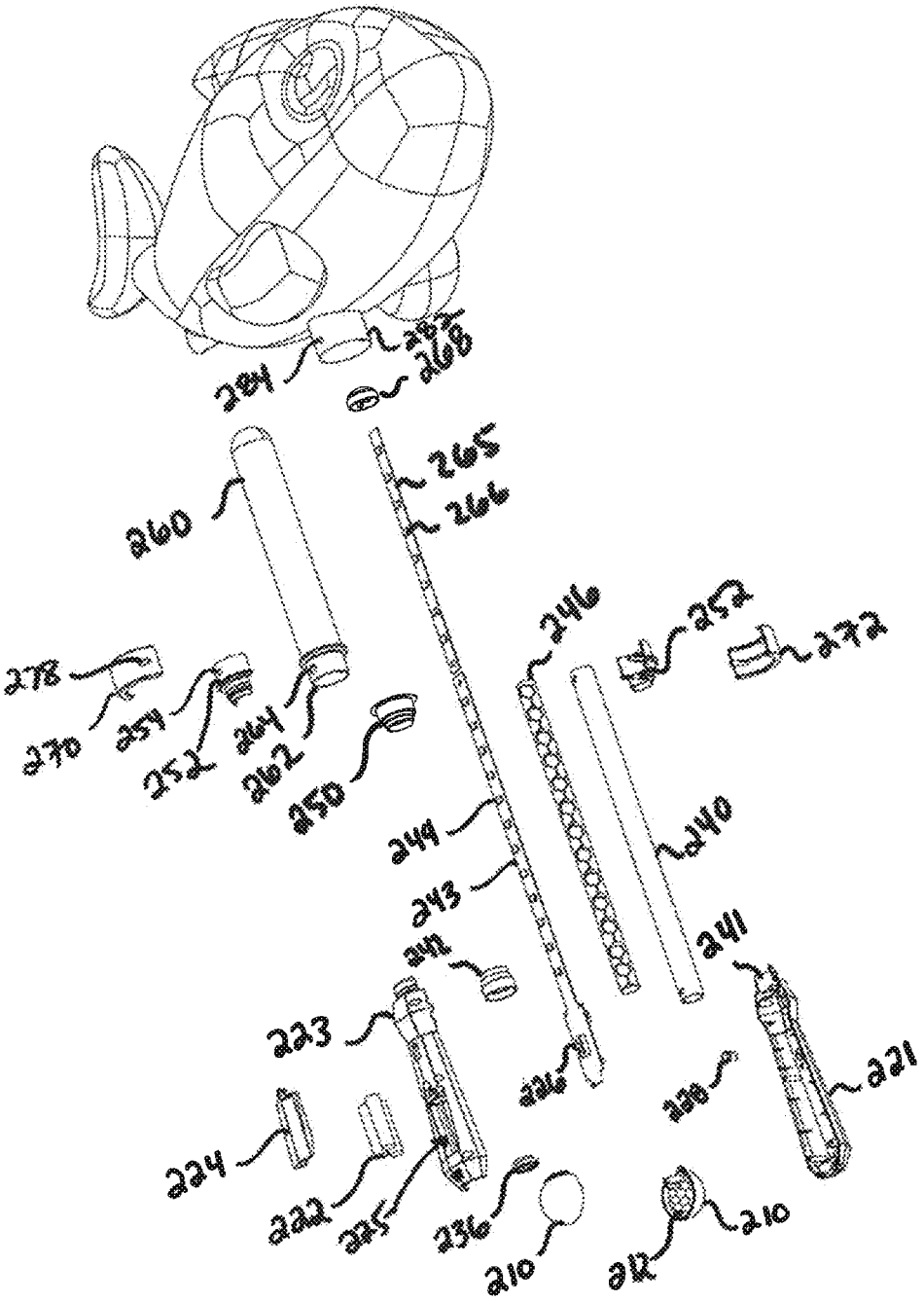
FIG. 12 is an exploded view of the illuminating balloon toy shown in FIG. 7 with a prismatic light reflector secured within the shaft.

As shown in FIGS. 11-12, the sphere 210 is preferably coated with a prismatic pattern 212, or made of a prismatic patterned material, such as plastic which reflects light in a unique pattern onto any surface. As shown in FIG. 11, a first LED 214 and a second LED 216 are secured to a first printed circuit board 215 at the end of the housing connected to the sphere. More particularly, the first and second LED are positioned to direct light into the sphere, so that light is reflected through the prismatic pattern and on to a surface in a unique way. Advantageously, the first printed circuit board to which the first and second LEDs are connected controls them and illuminates them in varying speeds, sequences, times and colors to create a unique light show that is projected through the sphere onto external surfaces. More particularly, due to the variable timing of the illumination of the first and second LEDs, the light appears to be moving or animated. The illumination of the first and second LEDs is timed in sequence with the remaining lights in the toy or independently.

Figure 15:
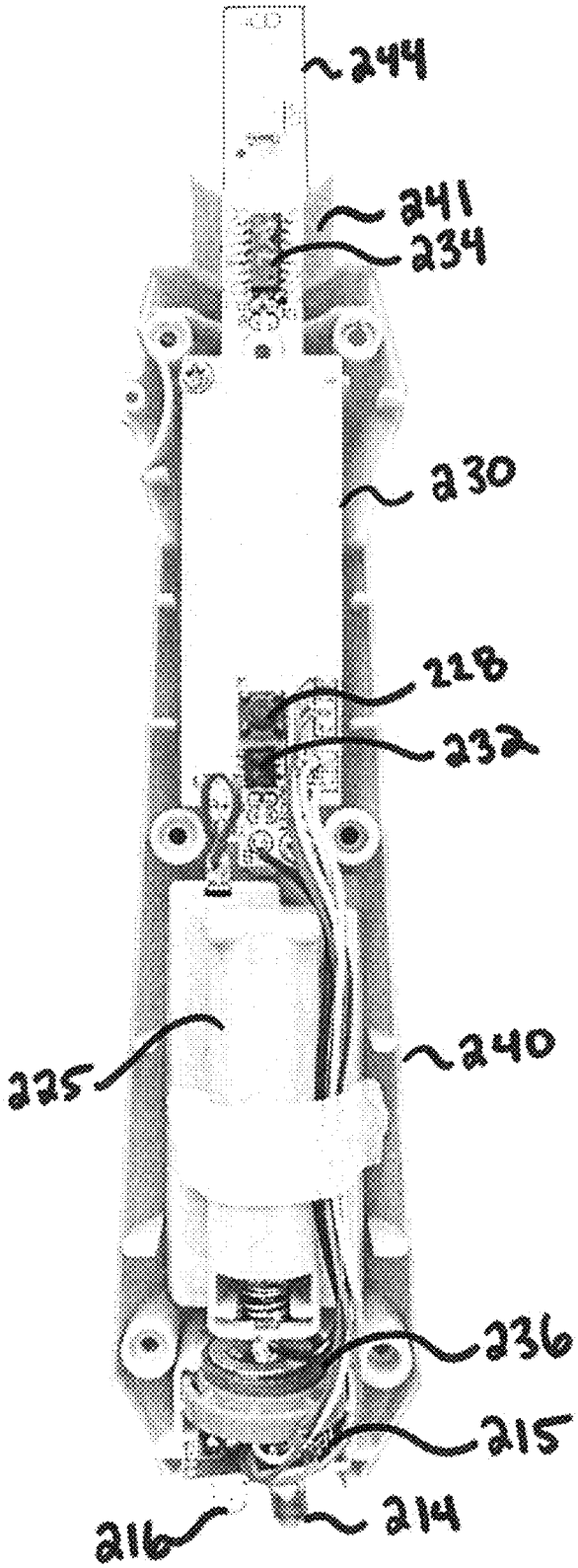
FIG. 15 shows the electronic components of the illuminating balloon toy shown in FIG. 7, which components are secured within the housing.

As shown in FIGS. 7-10, the sphere 210 is connected to the housing 220 for instance by screwing the sphere into the housing. As shown in FIG. 12, the housing is made of outer walls, such as a front 221 and back wall 223, which secure together, for instance via screws, to form an inner cavity. As shown in FIGS. 11 and 12, and more particularly, FIG. 15, secured within this inner cavity are various electronic components that control and activate various functions of the toy 200. As shown in FIG. 12, the power source for the toy is batteries 222, which are secured in the housing within a battery compartment 225 via a battery compartment cover 224. As shown in FIGS. 11-12 and 15, further secured within the housing is a speaker 236 through which stored and programmed songs and audio files play. The audio files are stored on an audio integrated circuit 232 that is secured within the housing to a control circuit board 230. Further electrically connected to the circuit board is a microcontroller unit 234, which controls the light effects, such as timing, light intensity, color, etc., of the LEDs of the toy, i.e., the first and second LEDs (214, 216), the first and second LED strips (244, 266) and the remaining LEDs 269 secured throughout the toy. Further it controls the audio integrated circuit to playback sound files. Advantageously, in one mode, the microcontroller unit activates the first and second LED directed in the sphere and the first and second LED strips in the shaft 240 and balloon 280 to illuminate in a unique pattern that is synchronized with the sound being played. Accordingly, the toy illuminates in coordination with the audio played through the speaker. Further secured to the control board is a slide switch 226 and a push button 228. The slide switch is a three-way switch, so for example, when a user slides the switch up, the first and second LEDs and LED strips of the toy are illuminated in a preprogrammed manner in coordination with a sound being emitted from the speaker. When the switch is slid down, the first and second LEDs and LED strips of the toy are activated without any sound. When a user pushes the push button, the LEDs sequence through various preprogrammed light shows, wherein the first LED strip in the shaft and second LED strip in the balloon illuminate in unique ways, either in coordination with one another or in an independent pattern from one another with varying timing, speeds, intensity, colors, etc. For example, the LEDs that illuminate into the prismatic sphere 210 illuminate in a first unique pattern, while at the same time, the first LED strip within the shaft illuminates in a second unique light pattern, the second LED strip in the balloon illuminates in a third unique light pattern and the remaining LEDs within the balloon illuminate in a fourth unique light pattern all simultaneously. Another preprogrammed light show includes, for example, all the LEDS and LED strips within the toy sequencing through identical light patterns simultaneously. Another preprogrammed light show includes, for example, only some of the LEDs or LED strips illuminating or for, example illuminating in a timed manner, wherein the LEDs illuminate in sequential order from the sphere to the balloon and then back from the balloon to the sphere. Eventually once the user presses the button through all the programmed sequences, the toy turns off. Advantageously, with the use of the prismatic pattern 212 in the sphere, the first prismatic reflector 246 in the shaft, and the second prismatic reflector 263 in the balloon, the toy appears to be animated from the unique light patterns produced by the sequential timing of the LEDS illuminating through the reflectors.

As shown in FIGS. 11-12 and 15, a second printed circuit board 243 is secured to or forms part of the control circuit board 230. The second circuit board extends into the tubular shaft 240 and contains a first LED strip 244 secured thereto. As shown in FIGS. 11 and 12, secured around the entirety of the first light strip is a prismatic reflector 246. This light reflector is secured to the housing via a connector 242, which secures into a shelf 241 formed by the connection of the front 221 and back walls 223 of the housing. As shown in FIG. 12, this light reflector includes a unique prismatic pattern, which advantageously splits light from the first LED strip from within the shaft. The light reflector is a clear plastic and preferably includes a prismatic pattern, and advantageously splits the light from the first LED strip and reflects said light into the shaft in various directions and patterns creating an animated appearance. This illumination is visible through the shaft, which is transparent or slightly opaque, thereby allowing the light to reflect within the shaft itself creating a unique pattern on the inside surface of the shaft.

As shown in FIGS. 7-14, connectable around the shaft 240 is an inflatable balloon 280. This connection is advantageous as it allows the balloon to be easily replaceable, for instance if it pops and/or if a user desires a different balloon to be affixed to the shaft. Furthermore, the connection is sealed in such a way that air does not leak from the balloon, even if a user aggressively plays with the balloon. As shown in FIGS. 11-14, secured around the shaft is a connector assembly, which includes a base 250, which is connected to a body 252. The base and the body of the connector assembly are secured around the second end of the shaft, for instance via screws or friction fitting. The base and the body of the connector assembly aid in the connection of the inflatable balloon to the shaft as well as securing a tube 260 within the inflatable balloon. As shown in FIG. 11, the tube extends into the balloon and is connected inside the body of the connector, for instance via a portion 262 that extends therein and is friction fitted to the body. Further, the extending portion of the tube includes a screw hole 264 for a screw to secure through the extending portion, and body of the connector assembly. As shown in FIGS. 11 and 12, the tube connector includes a third printed circuit board 265, to which a second LED strip 266 is electrically connected, for instance via soldering. This second LED strip is electrically connected to the first LED strip 244 via a standard printed circuit board connection. Advantageously, these LED strips are illuminated in sequence simultaneously or independently of one another to create unique light effects. To aid in ensuring the second LED strip is safely held in place within the inflatable balloon, an LED support dome 268 is secured in an upper portion of the tube. Further, in one embodiment, the hollow tube includes a prismatic reflector secured throughout an inside surface of the hollow tube, similarly to the prismatic reflector 246 secured within the shaft.

As shown in FIG. 11, secured within a lower portion of the hollow tube 260 and around the third printed circuit board 265 and second LED strip 266 is a fourth printed circuit board 267 with LEDs 269 secured thereto. These LEDs are further encompassed by a light reflector 263 which is a clear plastic and preferably includes a prismatic pattern, which advantageously splits the light from the LEDs and reflects said light into the inflatable balloon 280 and the hollow tube in various directions and patterns. The light reflector is dome shaped, but can have any shape, design, images, etc. to reflect the light into interesting and unique ways into the balloon and the tube.

Figure 13:
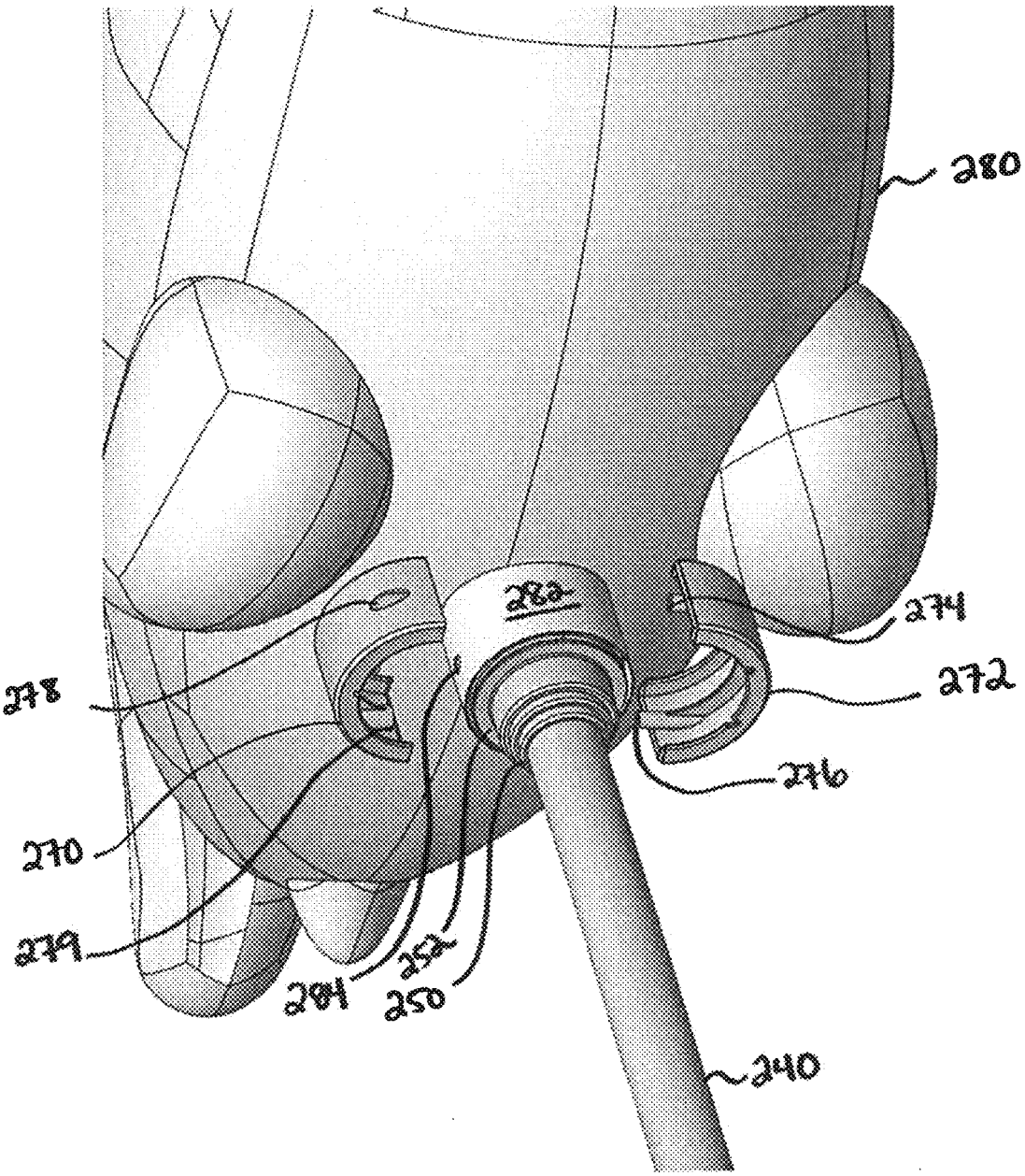
FIG. 13 is a bottom, perspective view of the connection of the shaft to the inflatable balloon of the illuminating balloon toy shown in FIG. 7, which includes mated locking collars that secure around a balloon sleeve.
Figure 14:
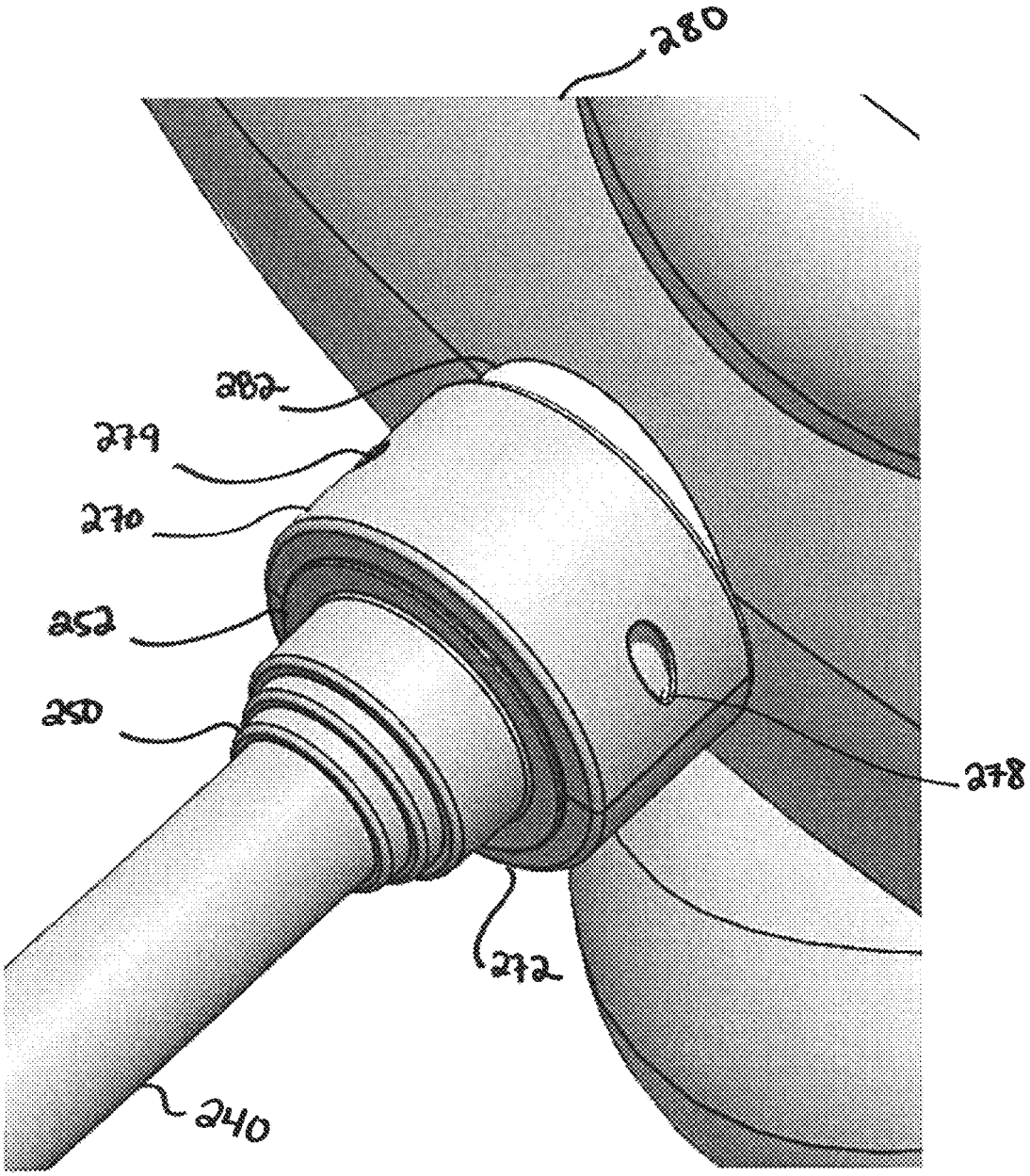
FIG. 14 is a bottom, perspective view of the connection of the shaft to the inflatable balloon of the illuminating balloon toy shown in FIG. 7, wherein the mated collars are locked around the balloon sleeve.

As shown in FIG. 11, the connection of the base 250 to the body 252 of the connector assembly uniquely create a groove 256 into which a male 272 and female 270 locking collar secure. As shown in FIGS. 12-14, the inflatable balloon includes a sleeve 282, which extends therefrom, and friction fits around the body of the connector assembly. The sleeve also includes a screw hole 284 into which a screw secures through the tube extension screw hole 264, the connector body screw hole 254 and the finally the sleeve to secure these components together. The balloon sleeve is sealed off from the inflatable portion of the balloon further ensuring that the balloon is airtight. The balloon is either inflated when manufactured or is inflatable by a user via a nozzle. As shown in FIG. 13, the male locking collar includes a first and second screw post (274, 276) into which first and second screw (278, 279) secure through the female locking collar. The female and male locking collars latch into the groove and secure the balloon sleeve in place, see FIG. 14. The unique securing mechanism of the inflatable balloon to the shaft allows a child to swing the balloon in the air without it separating from the toy. Further, it ensures that no air leaks from the toy. Further, the balloon is easily interchangeable or replaceable if desired.

It is well recognized by persons skilled in the art that alternative embodiments to those disclosed herein, which are foreseeable alternatives, are also covered by this disclosure. The foregoing disclosure is not intended to be construed to limit the embodiments or otherwise to exclude such other embodiments, adaptations, variations, modifications and equivalent arrangements.

The invention claimed is:

1. An illuminating balloon toy comprising:

a hollow shaft having a first and second end;

a housing connected to the first end of the shaft;

a tube connected to the second end of the shaft;

a printed circuit board secured within the tube proximate to the connection of the tube to the second end of the shaft;

a prismatic reflector secured within the tube adjacent to the printed circuit board;

a plurality of LEDs electrically connected to the printed circuit board and directed into the prismatic reflector;

an inflatable balloon secured around the tube;

a first LED strip secured within the shaft outside of the balloon; and a second LED strip secured within the tube inside of the balloon.

2. The illuminating balloon toy of claim 1, further comprising a sphere secured to the housing at an end opposite the connection to the shaft.

3. The illuminating balloon toy of claim 2, wherein at least one LED is secured within the housing and directed into the sphere.

4. The illuminating balloon toy of claim 1, wherein the plurality of LEDs and the first and second LED strip are programmed to illuminate the tube and the hollow shaft simultaneously or independently.

5. The illuminating balloon toy of claim 1, wherein the housing comprises a speaker and the plurality of LEDs are programmed to illuminate in synchronization with sound from the speaker.

6. The illuminating balloon toy of claim 1, further comprising a receiver for wireless activation of the plurality of LEDs.

7. An illuminating balloon toy comprising:

a hollow shaft having a first and second end;

a housing connected to the first end of the shaft, wherein the housing contains a speaker;

a tube connected to the second end of the shaft;

a printed circuit board secured within the tube proximate to the connection of the tube to the second end of the shaft;

a prismatic reflector secured within the tube adjacent to the printed circuit board;

a plurality of LEDs electrically connected to the printed circuit board and directed into the prismatic reflector;

an inflatable balloon secured around the tube;

a first LED strip secured within the shaft outside of the balloon; and a second LED strip secured within the tube inside of the balloon.

8. The illuminating balloon toy of claim 7, further comprising a sphere secured to the housing at an end opposite the connection to the shaft.

9. The illuminating balloon toy of claim 8, wherein at least one LED is secured within the housing and directed into the sphere.

10. The illuminating balloon toy of claim 7, wherein the first and second LED strip are programmed to illuminate in synchronization with sound from the speaker.

11. The illuminating balloon toy of claim 7, further comprising a receiver for wireless activation of the second LED strip and speaker.

12. An illuminating balloon toy comprising:

a hollow shaft comprising a first and second end;

a housing secured to the first end of the shaft;

a prismatic reflector secured within the hollow shaft, which separates the shaft into a first and second region, wherein the prismatic reflector is secured proximate to an entrance of the second region;

a printed circuit board secured within the shaft proximate to the entrance of the second region of the shaft;

a plurality of LEDs electrically connected to the printed circuit board and directed into the prismatic reflector;

an inflatable balloon attachable around the second region of the shaft;

a first LED strip secured outside of the balloon within the first region of the hollow shaft; and a second LED strip secured inside of the balloon within the second region of the shaft.

13. The illuminating balloon toy of claim 12, further comprising a sphere secured to the housing at an end opposite the connection to the shaft.

14. The illuminating balloon toy of claim 13, wherein at least one LED is secured within the housing and directed into the sphere.

15. The illuminating balloon toy of claim 12, further comprising a speaker secured within the housing.

16. The illuminating balloon toy of claim 15, wherein the first and second LED strip are programmed to illuminate in synchronization with sound from the speaker.

17. The illuminating balloon toy of claim 12, further comprising a second prismatic reflector secured around the first LED strip within the first region of the hollow shaft.

* * * * *